US006179055B1

(12) United States Patent
Sallwasser et al.

(10) Patent No.: US 6,179,055 B1
(45) **Date of Patent: *Jan. 30, 2001**

(54) CONVEYING A TOOL ALONG A NON-VERTICAL WELL

(75) Inventors: Alan J. Sallwasser; Roger A. Post; Carl J. Roy, all of Houston, TX (US)

(73) Assignee: Schlumberger Technology Corporation, Houston, TX (US)

( * ) Notice: Under 35 U.S.C. 154(b), the term of this patent shall be extended for 0 days.

This patent is subject to a terminal disclaimer.

(21) Appl. No.: 09/150,822

(22) Filed: Sep. 11, 1998

Related U.S. Application Data

(63) Continuation-in-part of application No. 08/924,672, filed on Sep. 5, 1997, now Pat. No. 5,954,131.

(60) Provisional application No. 60/088,645, filed on Jun. 9, 1998.

(51) Int. Cl.[7] ..... E21B 47/00

(52) U.S. Cl. ..... 166/254.2; 166/206; 175/96; 175/230

(58) Field of Search ..... 166/254.2, 206, 166/209; 175/94–99, 230; 405/156, 154

(56) References Cited

U.S. PATENT DOCUMENTS

| | | |
|---|---|---|
| 2,727,722 | 12/1955 | Conboy . |
| 3,827,512 | 8/1974 | Edmond . |
| 3,888,319 | 6/1975 | Bourne et al. . |
| 4,031,750 | 6/1977 | Youmans et al. . |
| 4,071,086 | 1/1978 | Bennett . |
| 4,095,655 | 6/1978 | Still . |
| 4,141,414 | 2/1979 | Johansson . |
| 4,192,380 | 3/1980 | Smith . |
| 4,460,920 | 7/1984 | Weber et al. . |
| 4,463,814 | 8/1984 | Horstmeyer et al. . |
| 4,570,709 | 2/1986 | Wittrisch . |
| 4,643,377 | 2/1987 | Christianson . |
| 4,686,653 | 8/1987 | Staron et al. . |
| 5,018,451 | 5/1991 | Hapstack . |
| 5,121,694 | 6/1992 | Zollinger . |
| 5,184,676 | 2/1993 | Graham et al. . |
| 5,375,668 | 12/1994 | Hallundbaek . |
| 5,794,703 | 8/1998 | Newman et al. . |

FOREIGN PATENT DOCUMENTS

| | | |
|---|---|---|
| 3311094 A1 | 3/1983 | (DE) . |
| 19534696 A1 | 9/1995 | (DE) . |
| WO 98/06927 | 2/1998 | (WO) . |

OTHER PUBLICATIONS

"Well Tractor," *Welltec Well Technologies,* Statoil, Denmark No Date.

K. Ostvang, J. Haukvik, T. Skeie, J. Hallundbaek, "Wireline Tractor Operations Successful in Horizontal Wells," Apr., 1997, *World Oil,* pp. 125–132.

*Primary Examiner*—Thomas B. Will
*Assistant Examiner*—Jong-Suk Lee
(74) *Attorney, Agent, or Firm*—John J. Ryberg; Brigitte L. Jeffery

(57) ABSTRACT

A conveyance apparatus for conveying at least one logging tool through an earth formation traversed by a horizontal or highly deviated borehole. The conveyance apparatus comprises a pair of arcuate-shaped cams pivotally mounted to a support member, a spring member for biasing the arcuate surface of each cam into contact with the borehole wall, and actuators operatively connected to each cam. A logging tool is attached to the conveyance apparatus. When either actuator is activated in a first direction, the cam connected to the activated actuator is linearly displaced forward and the arcuate surface of the cam slides along the borehole wall. When either actuator is activated in a second direction, the activated actuator pulls the connected cam backwards and the spring member thereby urges the arcuate surface of the cam to lock against the borehole wall. Once the cam is locked, further movement of the actuator propels both the conveyance apparatus and the logging tool forward along the highly deviated or horizontal borehole.

23 Claims, 14 Drawing Sheets

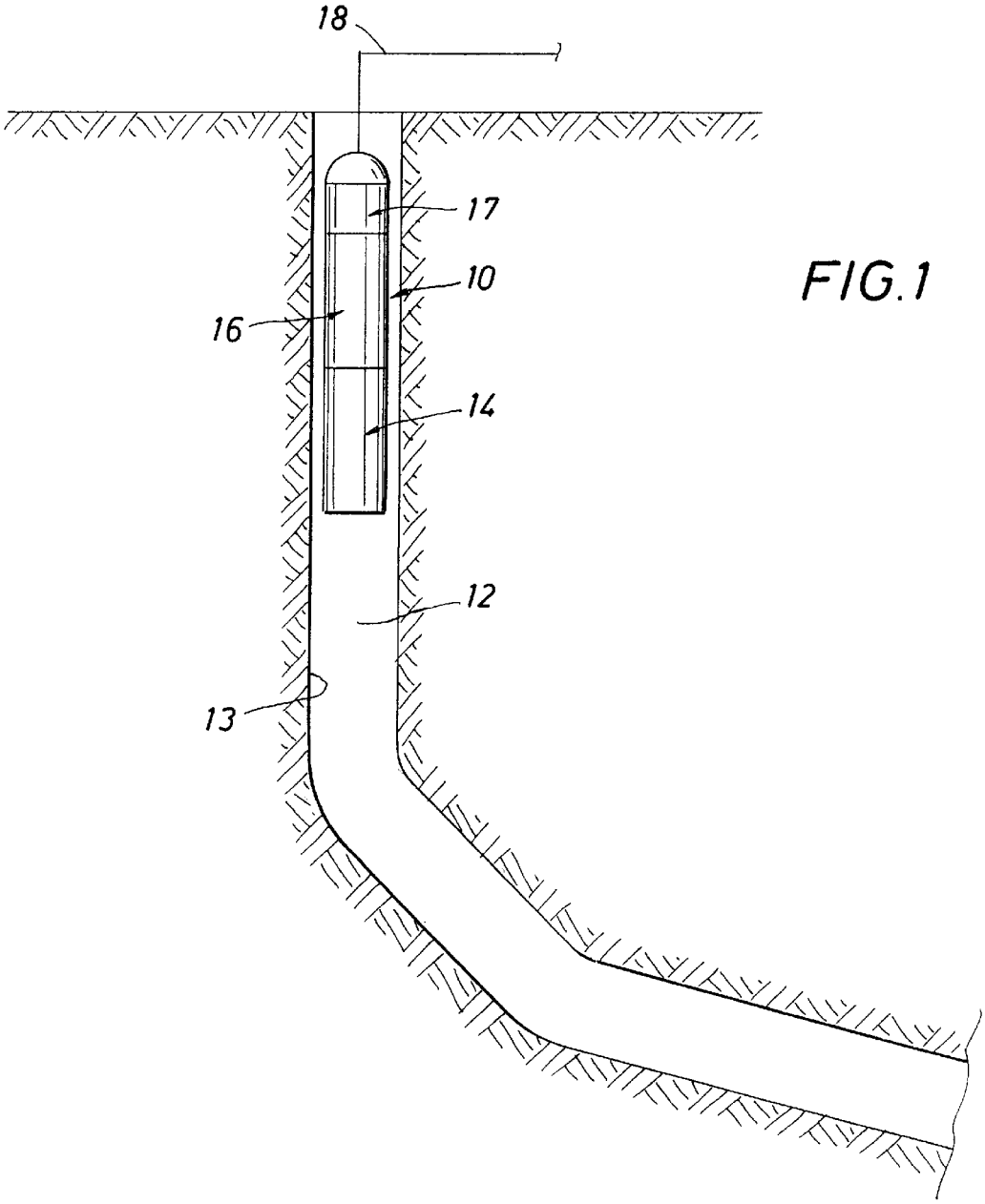
FIG.1
FIG.2
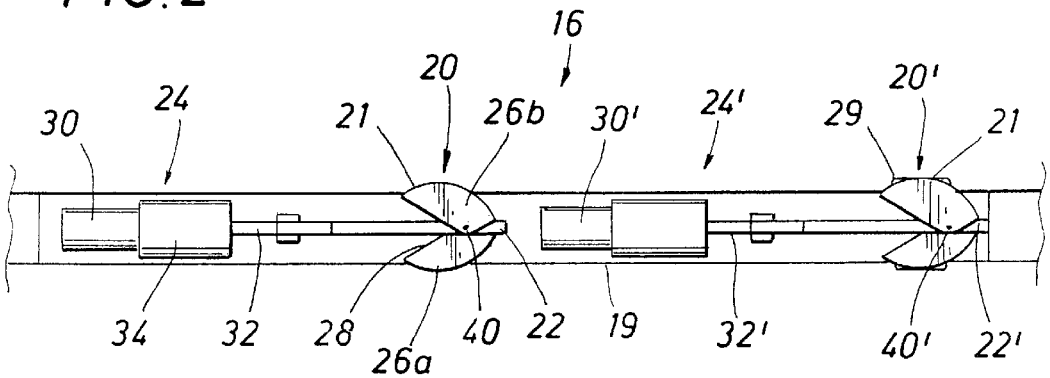

PULL STROKE 24
PULL STROKE 24'
RETURN 24'
RETURN 24
0
6
12
18
24
27
30
33
36
TIME (sec)
18
0
POSITION OF ACTUATORS (INCHES)
1800
900
0
TRACTOR VALOCITY (ft/hr)
TIME
400
200
0
TRACTOR PULL (lbs)
TIME

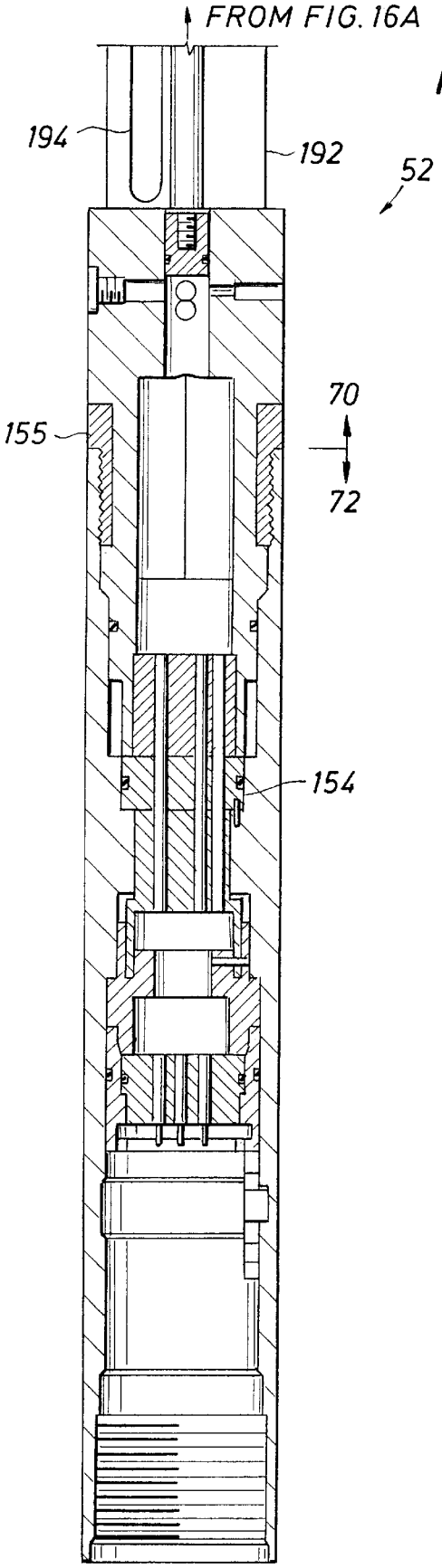
FIG. 16B
FIG. 17A
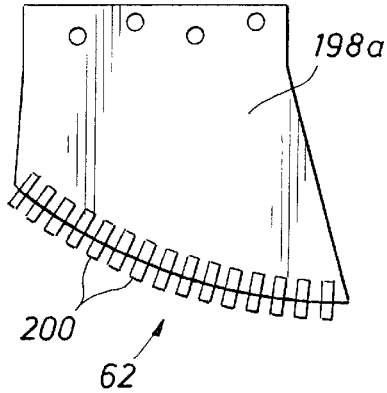
FIG. 17B
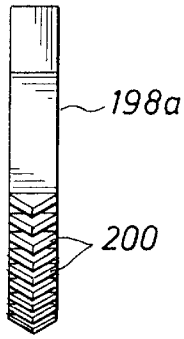
FIG. 17C
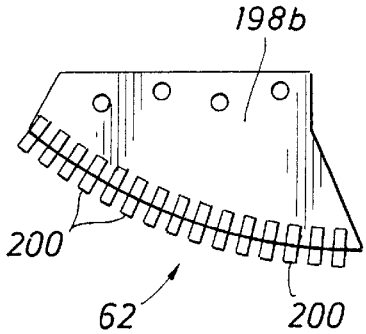

CONVEYING A TOOL ALONG A NON-VERTICAL WELL

CROSS REFERENCE TO RELATED APPLICATIONS

This application is a continuation-in-part of U.S. patent application Ser. No. 08/924,672, filed Sep. 5, 1997, now U.S. Pat. No. 5,954,131 and also claims the benefit of U.S. provisional application Ser. No. 60/088,645, filed Jun. 9, 1998.

BACKGROUND OF THE INVENTION

The present invention relates generally to a tool conveyance system, and more particularly, to a method and apparatus for conveying a tool along a non-vertical well.

To economically produce hydrocarbons from a reservoir, it has become increasingly common to drill a borehole, through an earth formation, which deviates from the traditional vertical orientation. The deviation may result from drilling a borehole using either a sharp or gradually increasing angle away from the vertical axis. The deviation may also result from drilling a borehole which extends horizontally from a vertical shaft. Generally the formations surrounding such deviated or horizontal boreholes are logged, and the wells completed, with tools lowered into the wellbore on a wireline or cable. Such tools usually depend upon the force of gravity to convey the tool along the well or borehole. However, when the borehole is drilled at a sufficiently high angle, or the inner surface of the well is particularly rough, the force of gravity is insufficient to overcome the friction of the tool and wireline against the inner surface of the well. Stiff devices, such as drill pipe and coiled tubing, have been used for pushing logging tools along horizontal and highly deviated boreholes. Drill pipe and coiled tubing conveyance are not ideally suited to all conditions, however. For instance, connecting and disconnecting drill pipe can be very labor-intensive and expensive, and coiled tubing conveyance is limited because of helical buckling of the tubing.

Previous attempts to propel tools along a deviated well bore have included providing such tools with driven wheels for tractoring the tools along the well, or with gripping feet hydraulically extended from the outside of the tool. Packaging such systems within the diameter of some well tools can be difficult, however, and may lead to non-optimal solutions. For instance, packaging motors powerful enough to drive wheels extending from the tool often requires the motors to be coupled to their respective wheels through 90 degree gear boxes. The distance to which gripping feet may be extended from the surface of the tool is also typically limited by packaging limitations and the required bore length of an associated actuating cylinder mounted across the tool. Many of the means developed for driving large pipeline inspecting and cleaning machines along pipe bores are not applicable to conveying tools along wellbores, simply due to the size restrictions of the small diameter bores. Many well casings are not more than about four or six inches in diameter.

Furthermore, electrically powered downhole systems should be as efficient as possible to reduce wireline current and the losses associated with transporting such current over extremely long cables. Unfortunately, increasing cable diameter to supply more power, either hydraulic or electric power, also increases the force required to drag the heavier cable along a horizontal well bore.

Thus, a more economical and expedient means of conveying a tool through the horizontal or highly deviated portion of a borehole is desired. Ideally, a conveyance apparatus will be able to readily adapt to a large variety of different inner diameters along the same well. Preferably, a conveyance tool which engages the inside surface of the well would also reliably disengage the well surface upon a loss of power or other foreseen failure, to enable the tool to be safely retrieved.

SUMMARY OF THE INVENTION

The present invention features an improved downhole conveyance system for conveying tools, such as logging tools, along a non-vertical well.

According to one aspect of the invention, an apparatus for conveying a tool along a non-vertical well is provided. The apparatus includes an elongated housing adapted to be attached to a tool to be conveyed, a cam anchor arranged to extend laterally from the housing and pivotably attached to the housing at a linearly displaceable pivot point, and an actuator operatively connected to the housing and constructed to linearly displace the cam anchor pivot point along the housing. The cam anchor has an arcuate cam surface for slidingly engaging an inner surface of the well as the cam anchor pivot point is displaced in a first direction, and for gripping the inner surface of the well as the cam anchor pivot point is displaced in a second direction, to convey the tool along the well.

Preferably, the apparatus has first and second such cam anchors attached to the housing at respective pivot points spaced along the housing, with the arcuate cam surfaces of the cam anchors aligned in a common direction. First and second such actuators are constructed to separately displace the pivot points of the first and second cam anchors, respectively, to convey the tool along the well.

In some presently preferred embodiments, the cam anchor is adapted to pivot about its pivot point to a retracted position, with its arcuate cam surface disengaged from the inner surface of the well. In some cases a spring is arranged to bias the cam anchor toward its retracted position.

In some embodiments, the cam anchor has a pair of oppositely directed anchor members pivotably attached to the housing at a common pivot point and arranged to simultaneously engage opposing portions of the inner surface of the well. Both anchor members are preferably adapted to pivot about their common pivot point to retracted positions with their arcuate cam surfaces disengaged from the inner surface of the well, the apparatus having spring arranged to bias both anchor members toward their retracted positions.

In some cases, the cam anchor has a plurality of projections extending from its arcuate cam surface for gripping the inner surface of the well. These projections are preferably of a hard, durable material, such as carbide.

The inner surface of the well may consist of earth or well casing, for example.

In some embodiments, the conveyed tool contains both a logging sensor responsive to a downhole well characteristic, and electronics adapted to activate the actuator.

Preferably, the apparatus is adapted to automatically retract the cam anchor to its retracted position upon a loss of power. In one presently preferred embodiment, the apparatus includes a retract assembly comprising the cam anchor and a cocking piston. The retract assembly is linearly displaceable along a housing slot by the actuator between forward and rearward positions, with the cocking piston extending from the retract assembly and arranged to engage a surface of the housing at one end of the slot and to be compressed by the housing as the retract assembly is displaced to its forward position, thereby urging the cam anchor toward its extended position.

In some embodiments, the retract assembly includes a retract assembly housing, a retract piston, and an extension spring. The retract piston is disposed within a bore of the retract assembly housing and connected to the pivot point of the cam anchor. The retract piston is in hydraulic communication with the cocking piston and adapted to be displaced within the housing bore to move the pivot point as the cocking piston is compressed. The extension spring is connected to the retract assembly housing and the cam anchor and arranged to urge the cam anchor toward its extended position as the cocking piston is compressed.

In one preferred embodiment, the retract assembly includes a first one-way check valve arranged to enable hydraulic flow from the cocking piston to the retract piston as the cocking piston is compressed, a normally open solenoid valve arranged to enable hydraulic flow from the retract piston to the cocking piston in the absence of electrical voltage at the solenoid, and a spring arranged to bias the retract piston toward a cam-retracting position. Preferably, the apparatus also defines a compensation cavity in hydraulic communication with the retract piston and adapted to receive hydraulic fluid from the retract assembly when the solenoid valve opens and the cocking piston is blocked from fully extending.

According to another aspect of the invention, a method for conveying a tool along a non-vertical well to a predetermined position is provided. The method includes the steps of (a) attaching the above-described apparatus to a tool to be conveyed;

(b) lowering the tool and apparatus into a non-vertical well;

(c) activating the actuator to displace the cam anchor pivot point in the first direction to slide the cam anchor surface along an inner surface of the well;

(d) activating the actuator to displace the cam anchor pivot point in the second direction to grip the inner surface of the well and convey the tool along the well; and (e) repeating steps (c) and (d) until the tool is conveyed to a predetermined position.

In some embodiments of the inventive method, in which the apparatus has two sets of cam anchors and associated actuators, above steps (c) and (d) include:

i) activating both actuators to displace both cam anchor pivot points in the second direction to engage the cam anchors against the inner surface of the well; and ii) sequentially activating each actuator to sequentially displace the cam anchor pivot points in the first direction to convey the tool along the well.

In some instances, the above step i) includes activating one actuator to displace one cam anchor pivot point in the first direction, while simultaneously activating the other actuator to displace the other cam anchor pivot point in the second direction.

In some other embodiments of the inventive method, in which the apparatus has two sets of cam anchors and associated actuators, the method includes, between above steps (b) and (c), activating both actuators to displace both cam anchor pivot points in the second direction to engage the cam anchors against the inner surface of the well and, while maintaining one cam anchor in engagement with the inner surface of the well, performing steps (c) and (d). Steps (c) and (d) in these embodiments include activating the actuator associated with the other cam anchor to reciprocate the other cam anchor pivot point in the first and second directions to convey the tool along the well. The one cam anchor may be biased toward the inner surface of the well by a spring.

In some embodiments, the conveyed tool contains a logging sensor responsive to a downhole well characteristic. In some cases the conveyed tool also contains electronics adapted to activate the actuator.

Advantageously, the anchors of the present invention do not require the application of large amounts of power to actively force them against the inner surface of the well. Essentially, their arcuate cam surfaces passively engage the casing wall, with the only engagement load applied by a relatively small spring. The bulk of the normal load developed between the cam anchors and the casing is from the forward-conveying force applied by the actuator. Thus, the complexity and cost of a separate cam-extending power device is not required, the cams automatically gripping when pulled in one direction, automatically releasing when pushed in the other direction.

Furthermore, the invention features a means for automatically retracting the cam anchors in the event of a power loss, thereby avoiding having to break the cam anchors to pull the tool string from the well.

The invention can provide an efficient, practical means of conveying tools, such as logging tools or well completion tools, along a non-vertical well. Further advantages of the present invention will be apparent from the following description of the accompanying drawings. It is to be understood that the drawings are to be used for the purpose of illustration only, and not as a definition of the invention.

BRIEF DESCRIPTION OF THE DRAWING

FIG. 1 illustrates a tool string in a deviated borehole.

FIG. 2 illustrates the conveyance apparatus of the subject invention.

FIGS. 17A and 17B are side and end views, respectively, of a first cam member outer portion.

FIG. 17C is a side and end view of a second cam member outer portion.

DESCRIPTION OF EMBODIMENTS

Figure 3A:
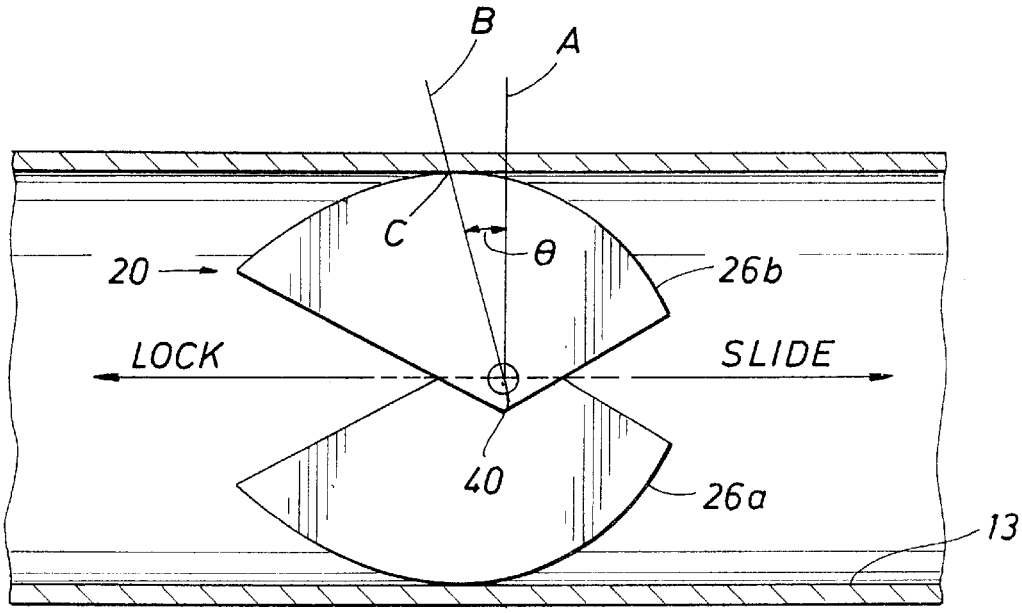
FIGS. 3A and 3B depict the conveyance apparatus within a small and large diameter borehole.

FIG. 1 schematically illustrates the lowering of a tool string 10 into a deviated well 12. Well 12 is typically lined with steel casing 13 cemented in place to the formation and may further include production tubing. However, it is within contemplation of the subject invention to have an open hole well, which may or may not be lined with casing. The tool string 10 includes at least one logging tool 14 attached to a conveyance apparatus 16. Tool string 10 also includes an electronics cartridge 17 for controlling conveyance apparatus 16. In some cases, electronics cartridge 17 also controls logging tool 14, and in some cases the cartridge includes one or more logging sensors and performs the function of logging tool 14. The tool string 10 is suspended by an armored cable 18 containing a sheathed electrical conductor (a mono-cable) for transmitting power and control signals from the surface of the well to the tool string, and data telemetry from the tool to the surface. A winch (not shown) at the surface of the well is used to lower and raise tool string 10 in the vertical portion of the well, and to pull the tool string along the non-vertical portions of the well.

In some cases, logging tool 14 is located at a distal end of tool string 10, as shown, forward of conveyance apparatus 16, such that conveyance apparatus 16 pushes logging tool 14 along the deviated portions of the well. In other cases, logging tool 14 is located at a proximal end of tool string 10, rearward of conveyance apparatus 16, such that the conveyance apparatus pulls the logging tool along the well.

FIG. 2 schematically illustrates an embodiment of conveyance apparatus 16, for one-way conveyance of a logging tool down a deviated well. Apparatus 16 has two cam-actuator sets mounted within a common housing 19. One cam-actuator set consists of a cam anchor 20 having two oppositely directed cam members 26*a* and 26*b*, a support frame 22, and an actuator 24. Linear actuator 24 is constructed to linearly displace support frame 22 along housing 19 (i.e., in a direction extending along the well), thus displacing a pivot point 40 at which the two cam members of cam anchor 20 are both pivotably mounted to support frame 22. Cam members 26*a* and 26*b* have outer arcuate surfaces 21 of a strong, corrosion and wear resistant material, such as stainless steel, for engaging the inner surface of the well. A compression spring 28, extending between cam members 26*a* and 26*b*, is arranged to bias the arcuate surfaces of the oppositely directed cam members into contact with inner surface of the well. Other biasing means may be employed, however, such as torsion or extension springs. Other means for biasing cam anchor 20 against the borehole, including electro-mechanical or hydraulically activated systems, are within contemplation of this invention.

A second cam-actuator set, consisting of a cam anchor 20', a support frame 22', and an actuator 24', is of similar construction to that already described. The arcuate cam surfaces 21 of the cam members of cam anchor 20' are provided with projections 29, such as studded or particle members, to further improve the gripping of the inner surface of the well. Projections 29 consist of a material having high hardness and abrasion resistance properties, such as tungsten carbide. In other embodiments, cam anchor 20 has similar projections.

Still referring to FIG. 2, actuator 24 includes a motor 30 arranged to rotate a ball screw 32, coupled to the ball screw through a reduction gear box 34. Alternatively, actuator 24 may consist of other means for linearly displacing support frame 22, such as a hydraulic piston coupled to a motor driven, hydraulic pump. When motor 30 is rotated in one direction, ball screw 32 linearly displaces support frame 22, along with pivot point 40, forward. During this displacement, the arcuate surfaces of cam members 26*a* and 26*b* are free to slide along the borehole wall. When motor 30 is rotated in the opposite direction, ball screw 32 pulls pivot point 40 rearward, jamming or locking the arcuate surfaces of cam members 26*a* and 26*b* against the borehole wall and propelling the conveyance apparatus and logging tool forward. In various embodiments, described in more detail below, actuators 24 and 24' cooperate to move the tool along the well.

Figure 3B:
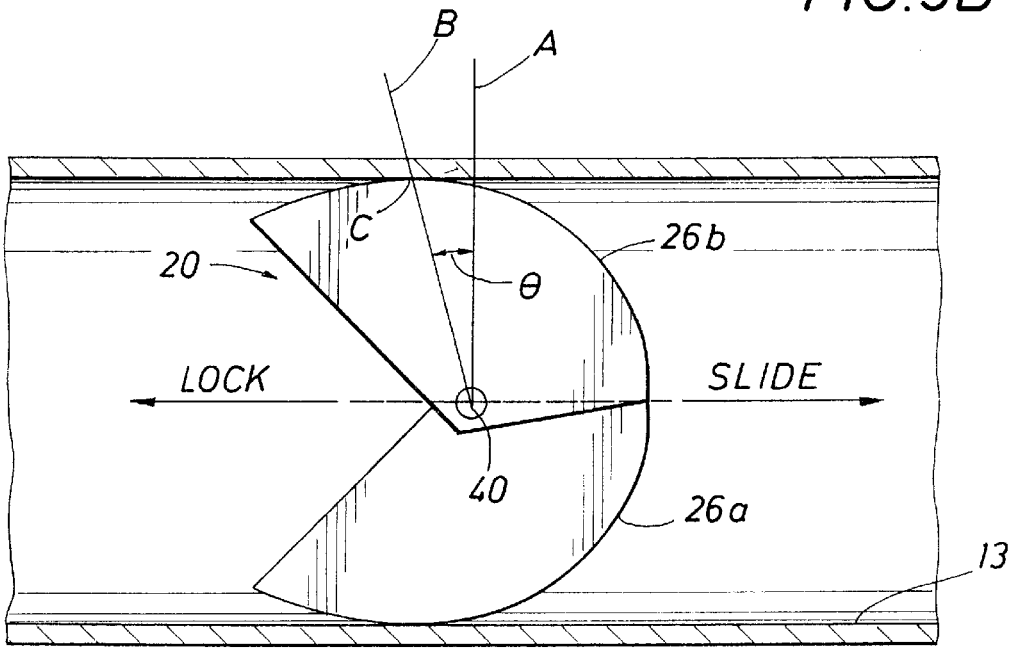

Conveyance apparatus 16 locks or slidingly engages wells having a variety of different inner diameters. FIGS. 3A and 3B depict cam anchor 20 within relatively small and large diameter casing 13, respectively. The contact angle, $\theta$, is defined between a direction "A" perpendicular to the bore of the casing, and a line "B" extending from pivot point 40 to the point "C" where cam member 26*b* engages casing 13. The maximum contact angle required to securely, non-slidably lock cam anchor 20 against the borehole wall relates to the friction characteristics between cam 20 and the wall of borehole 12. The tangent of the contact angle, $\theta$, must be smaller than the static coefficient of friction between surface 21 and casing 13, such that friction between the cam anchor surface and casing prevents sliding as the actuator pulls the cam anchor in the "lock" direction. Because contact point "C" is rearward of pivot point 40, cam anchor freely slides along the surface of casing 13 when moved in the "slide" direction. We presently prefer a contact angle of about 22 degrees, corresponding to a friction coefficient of about 0.4. To accommodate changes in casing diameters, arcuate cam surfaces 21 are shaped such that contact angle $\theta$ remains constant as cam members 26*a* and 26*b* pivot inwardly or outwardly about pivot point 40.

Actuators 24 and 24' are preferably activated in a controlled manner to cause the motions of cam anchors 20 and 20' to cooperatively move the tool string along the well. To prevent the tool from being moved rearward (i.e., toward the well opening), due to either the reaction to sliding one cam anchor forward or to tension in cable 18 (FIG. 1), one cam anchor is locked against the borehole at all times. In other words, as one cam anchor 20' or 20 is moved forward, the other cam anchor remains locked against the borehole wall, preventing rearward movement of the tool string.

Figures 4A, 4B, 4C:
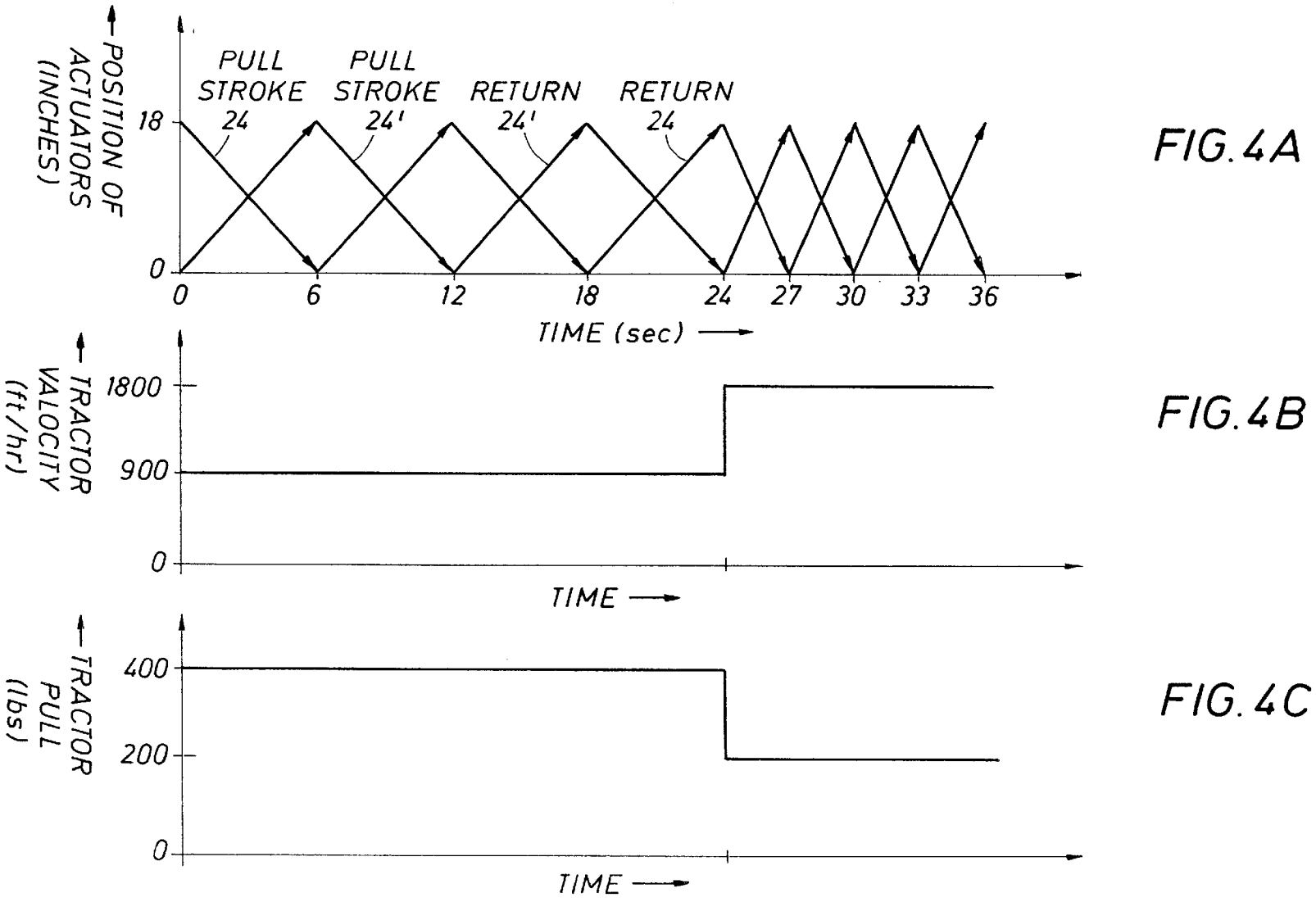
FIGS. 4A–4C illustrate position, velocity, and force versus time for continuous movement of a conveyance apparatus, according to the invention.

FIGS. 4A–4C illustrate position, velocity, and force versus time for continuous movement of the conveyance apparatus of FIG. 2, to which we also refer.

In the home position in one embodiment, at time t=0, the ball screw 32 of first actuator 24 is fully extended while the ball screw 32' of second actuator 24' is fully retracted. In order to convey the tool string forward, motor 30 of the first actuator rotates in one direction and retracts ball screw 32, pulling cam anchor 20 backward and thereby both locking the arcuate cam surfaces 21 of cam 20 against the borehole wall 12 and propelling the conveyance apparatus and logging tool forward. Simultaneously, motor 30' of actuator 24' rotates ball screw 32' to linearly displace pivot point 40' of cam anchor 20' forward to slide cam anchor 20' forward along the casing wall. These actions are then reversed, such that the first motor 30 rotates in the opposite direction to slide cam anchor 20 forward while the second motor 30' retracts support frame 22' to pull cam anchor 20' rearward, thereby locking the arcuate cam surfaces 21' of cam anchor 20' against the borehole wall and propelling the conveyance apparatus and logging tool further forward. Moving the cam anchors forward slightly faster than they are pulled rearward enables the timing of the two actuators to be configured with a slight overlap of their pull strokes, such that the net forward motion of the tool string is continuous, as illustrated in FIG. 4B. With the amount of electrical power available to the actuators through cable 18 (FIG. 1) limited, the maximum pulling force developed by the actuators will be lower at higher pulling velocities, as shown in FIG. 4C.

In another operational sequence, cam anchors 20 and 20' are first operated simultaneously, then sequentially. Actuators 24 and 24' are simultaneously activated to pull both cam anchors rearward, thereby locking their arcuate cam surfaces 21 against the borehole wall and propelling the tool string forward. Next, actuators 24 and 24' are sequentially activated to displace each cam anchor forward, after which both actuators again retract the cam anchors together to convey the tool string forward. These steps are repeated until the logging tool is conveyed to a predetermined position.

In a third operational sequence, one actuator is reciprocated to convey the tool string along the well step-wise, while the other actuator remains stationary, with its associated cam anchor locked against the casing wall to prevent rearward motion.

Figure 5:
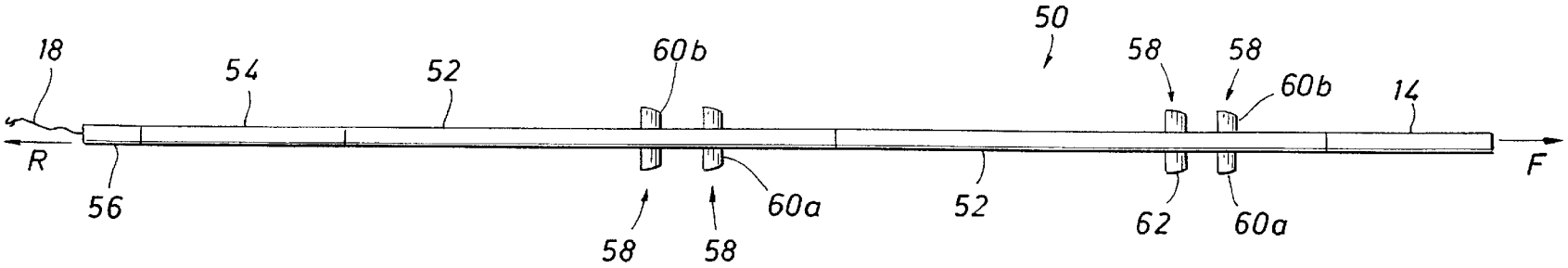
FIG. 5 illustrates a second tool string, with a conveyance apparatus having cam anchors adapted to automatically retract.

FIG. 5 illustrates another tool string 50, comparable to tool string 10 in FIG. 1 but having (from bottom to top) a logging tool 14, two tool conveyor sondes 52, an electronics cartridge 54, and a cable adaptor 56. Although only one logging tool 14 is shown, it should be understood that the tool string may have multiple logging tools or other such devices to be conveyed along a non-vertical well. Each conveyor sonde 52 has two cam anchors 58, each cam anchor having oppositely directed cam members 60*a* and 60*b*. Each conveyor sonde also has a single actuator (not shown) for moving its two cam anchors together. Each cam member 60*a* and 60*b* has an arcuate distal cam surface 62 for engaging an inner surface of the well casing, as described above with respect to the embodiment of FIG. 2, such that the cam anchors freely slide along the casing surface when moved in a forward direction, indicated by arrow "F", but lock against the casing surface when pulled in a rearward direction, indicated by arrow "R".

Figure 6:
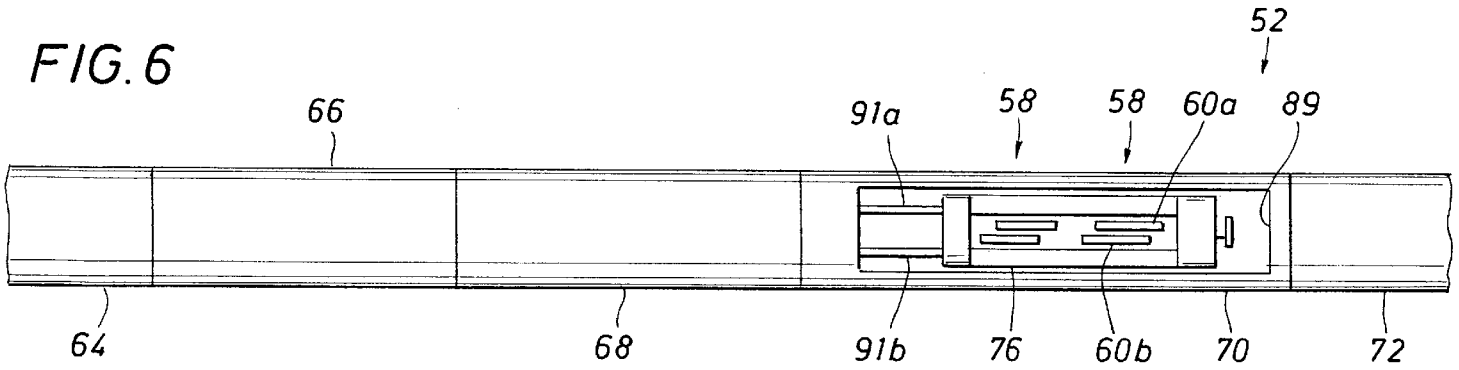
FIG. 6 is a side view of one of the conveyor sondes of FIG. 5.

Referring to FIG. 6, each conveyor sonde 52 consists of, from top to bottom, an upper head section 64, a compensator section 66, an actuator section 68, a rail section 70, and a lower head section 72. Rail section 70 contains a retract assembly 76 mounted within a slot 78 extending through opposite sides of the rail section. Retract assembly 76 contains the cam anchors 58 and is moved longitudinally along slot 78 by an actuator contained in actuator section 68. As explained below with respect to FIGS. 15 and 16, each conveyor sonde provides for electrical communication along the length of the sonde, for transmitting power and control signals to and from the attached logging tools or other devices.

Figure 7:
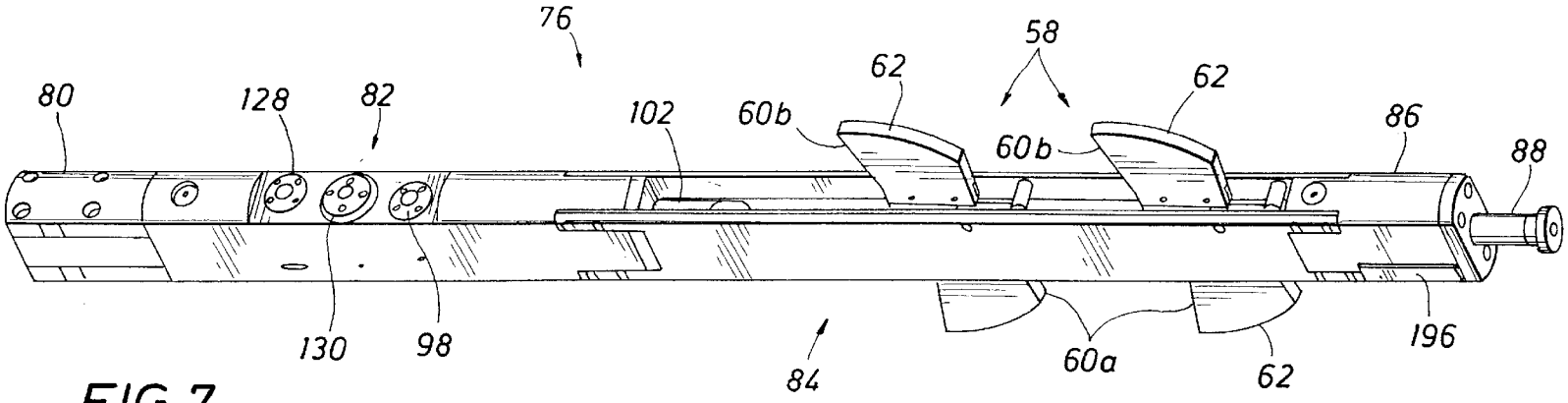
FIGS. 7 and 8 are perspective and side views, respectively, of the retract assembly of the conveyor sonde.
Figure 8:
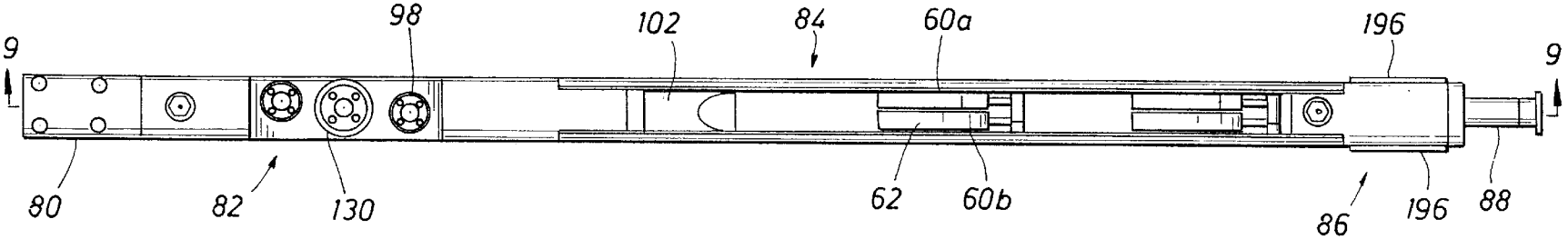

Referring to FIGS. 7 and 8, retract assembly 76 consists of, from left to right, an actuator rod clamp 80, a hydraulics block 82, an anchor section 84, and a cocking piston section 86. Distal ends of actuator rods 91*a* and 91*b* of the actuator section of the sonde (FIG. 16) are rigidly clamped within clamp 80 for moving the retract assembly back and forth. Hydraulics block 82, further described with respect to FIG. 12, contains hydraulic valving for controllably retracting the cam anchors in the event of a power failure. A cocking piston 88, extending from the cocking piston section of the retract assembly, is initially pushed inward by the forward motion of the retract assembly to generate hydraulic pressure for extending the cam anchors, as described in more detail below with respect to FIG. 9 and FIG. 12.

Figure 9A:
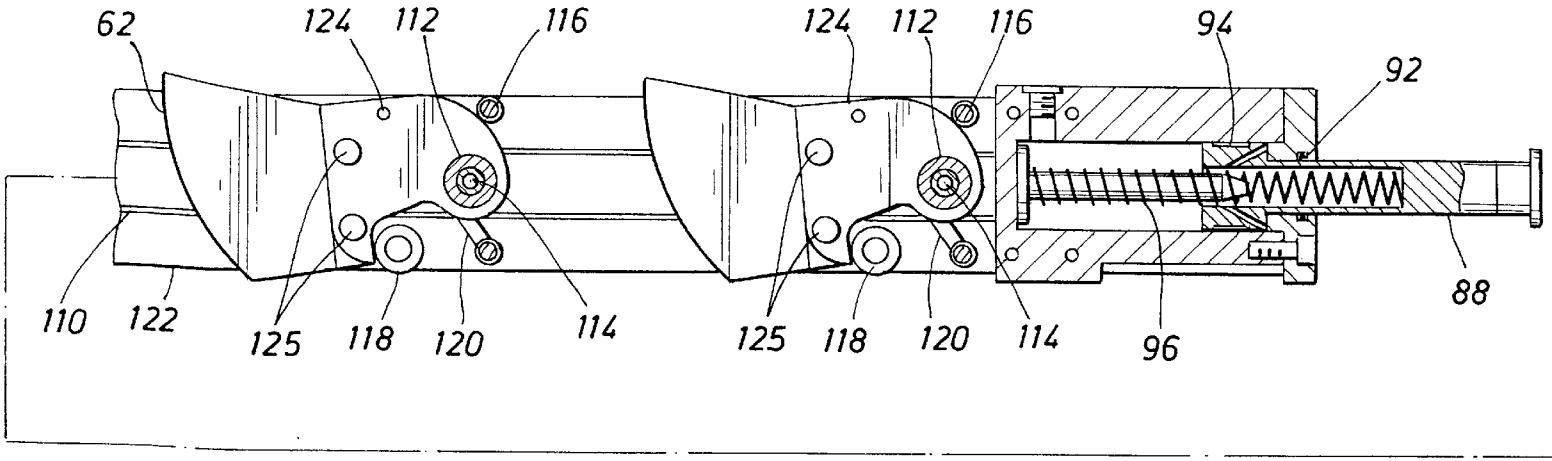
FIGS. 9 and 10 are cross-sectional views of the retract assembly with the cam anchors in retracted and extended positions, respectively, taken along line 9—9 in FIG. 8.
Figure 9B:
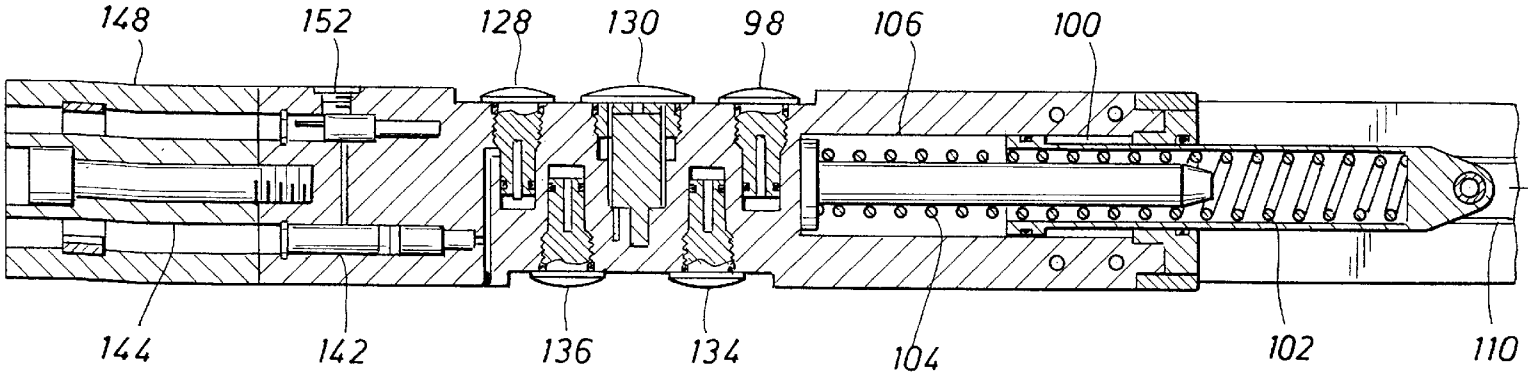
Figure 10A:
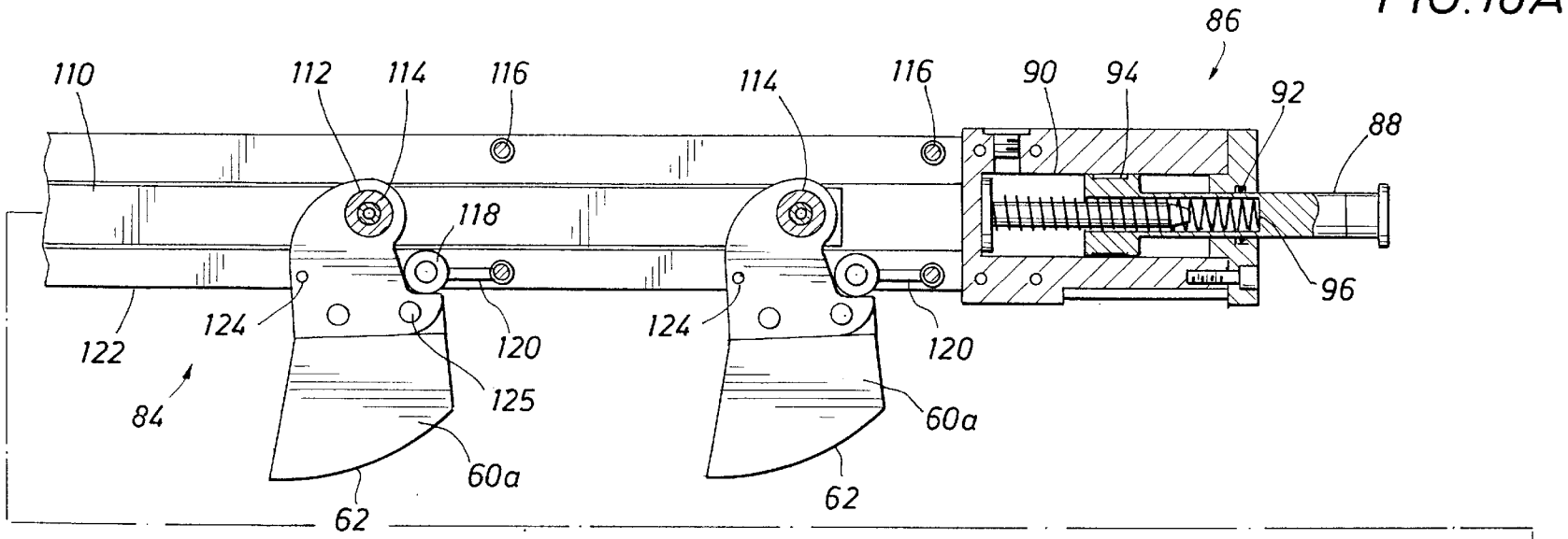
Figure 10B:
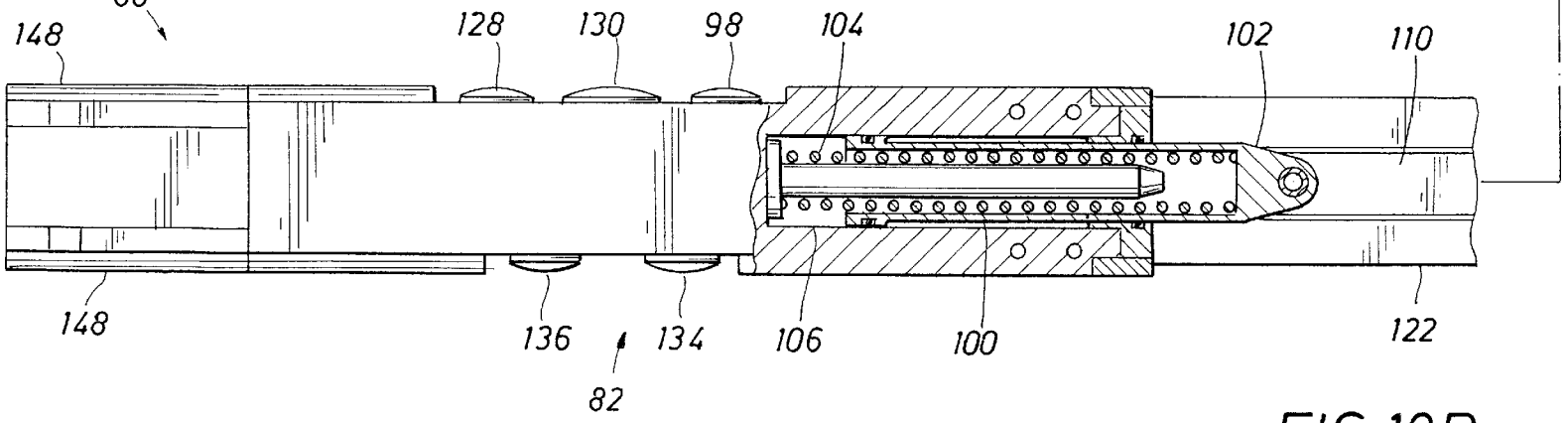
Figure 15A:
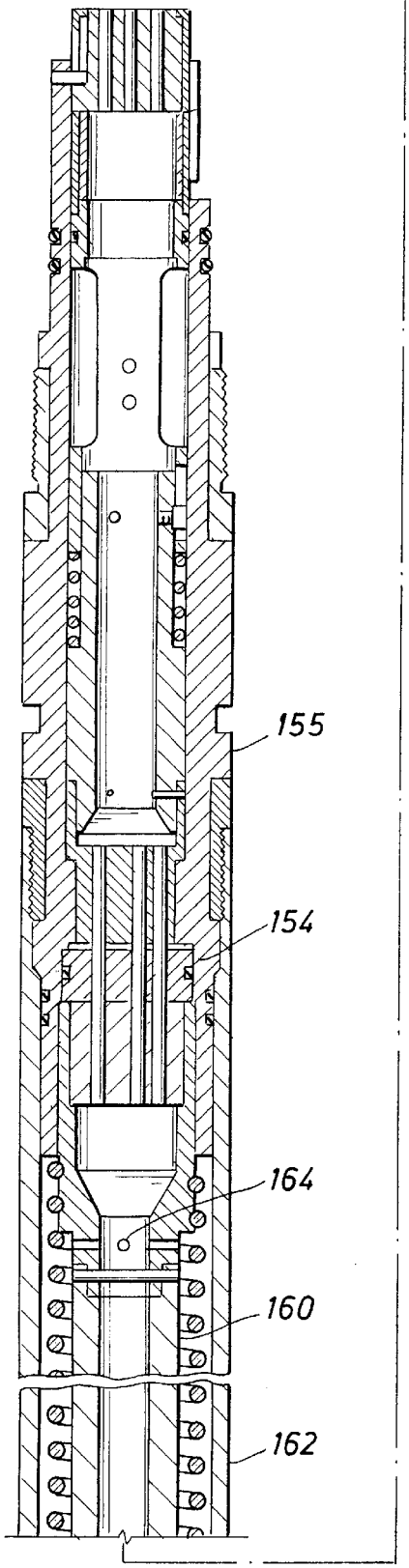
FIGS. 15 and 16 together form a single cross-sectional view illustrating the inner structure of the actuator and compensator sections of the conveyor sonde.
Figure 15B:
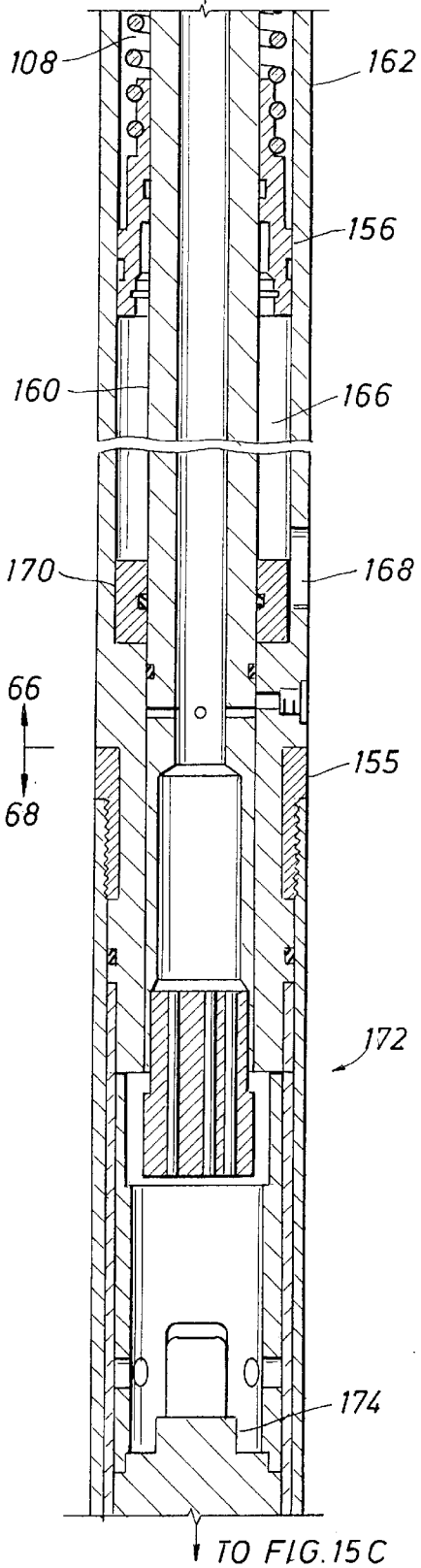
Figure 15C:
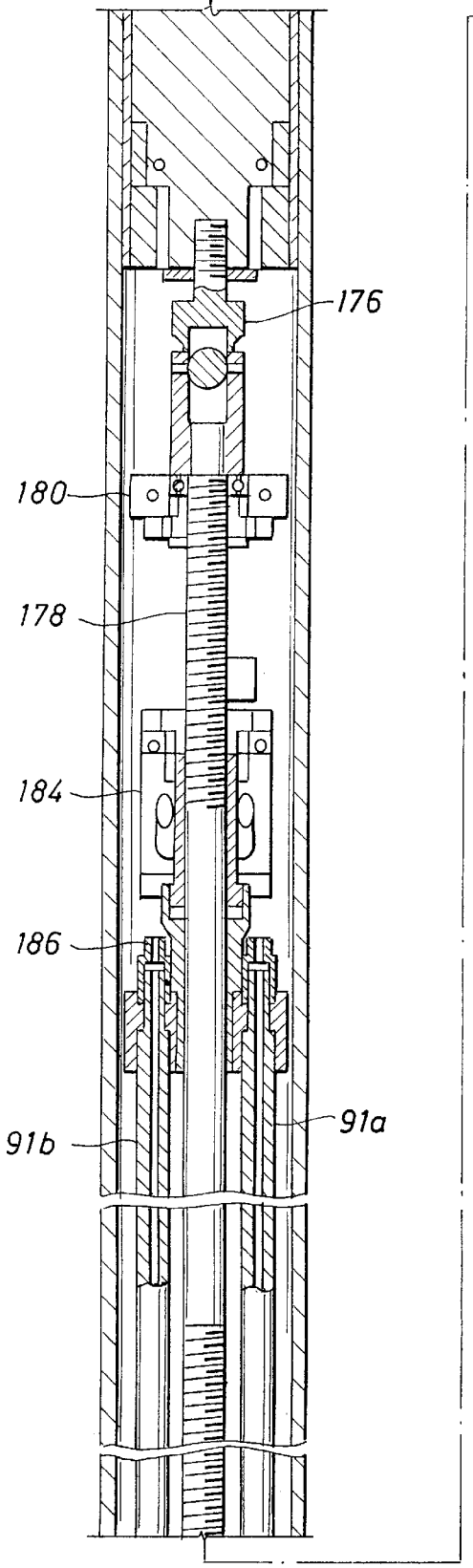

FIG. 9 shows retract assembly 76 with its cam anchors in a retracted position and cocking piston 88 extended. When the retract assembly is first moved forward to the extend of its travel by the sonde actuator, piston 88 contacts the lower bulkhead wall 89 of the sonde (FIG. 6), and is pushed into the retract assembly, forcing hydraulic fluid out of cocking cavity 90. Cavity 90 is sealed at its outer end by an o-ring seal 92 about the shaft of piston 88, which has an enlarged guide portion 94 which slides along the bore of cavity 90. A compression spring 96 urges piston 88 outward. The hydraulic fluid displaced from cocking cavity 90 flows along hydraulic tubing (not shown) enclosed within the retract assembly, through a one-way check valve 98 to annular cavity 100 about retract piston 102, forcing piston 102 to the left, to the position shown in FIG. 10, compressing retract spring 104. Simultaneously hydraulic fluid, displaced from cavity 106 by the motion of piston 102, flows through actuator rod 91*b* to a compensating piston cavity 108 in the compensator section of the sonde (FIG. 15). Twin cam support rails 110, attached to the distal end of piston 102, are pulled to the left as the retract piston retracts. Cam members 60*a* and 60*b* (only members 60*a* are visible in FIGS. 9 and 10) are attached to rails 110 through bearings 112, defining cam anchor pivot points 114. In their retracted position, as shown in FIG. 9, each cam member is held against a pin 116 and a roller 118 by an associated extension spring 120 extending between the cam member and the retract assembly housing 122, and by residual compression in spring 104. One end of each spring 120 is attached to its associated cam member by a pin 124. As cam support rails 110 are moved to the left, springs 120 urge their associated cam members outward to their extended positions, as shown in FIG. 10. When rails 110 are moved back to the right (as shown in FIG. 9), pivot points 114 are moved forward along the well with respect to rollers 118. This relative motion helps to retract the cam members and provides that any cable tension will be applied to the cam members through rollers 118 rather than through bearings 112.

As seen in FIGS. 9 and 10, cam members 60*a* (and 60*b*, not shown) each have inner and outer portions, releasably connected by threaded fasteners 125, such that their outer portions (having arcuate cam surfaces 62) are field-replaceable. Also, outer cam member portions of different sizes are provided, such as shown in FIGS. 17A and 17C, for use over different ranges of pipe diameters. Furthermore, in some cases one cam anchor 58 (FIG. 8) is provided with outer cam member portions of one size (e.g., that of FIG. 17A), while the other cam anchor is provided with outer cam member portions of another size (e.g., that of FIG. 17C), for accommodating a very wide range of borehole diameters in a single well.

Figure 11:
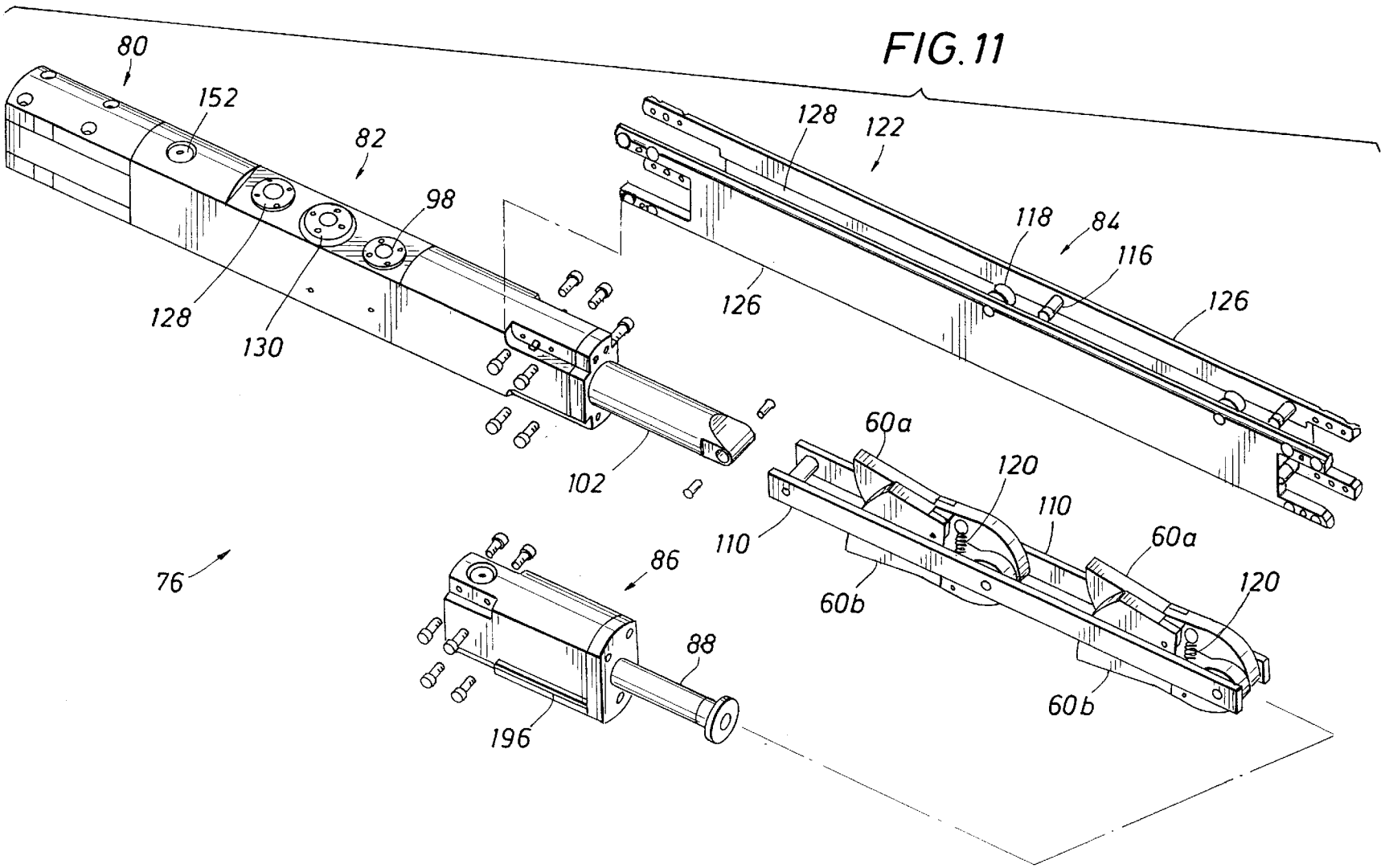
FIG. 11 is a perspective view of the retract assembly, showing an exploded view of its anchor section.

FIG. 11 provides, in some respects, a better view of the structure of the anchor section 84 of the retract assembly. Anchor section housing 122 has twin parallel side rails 126, each of which defines an inner groove 128 along which cam support rails 110 slide.

Figure 12:
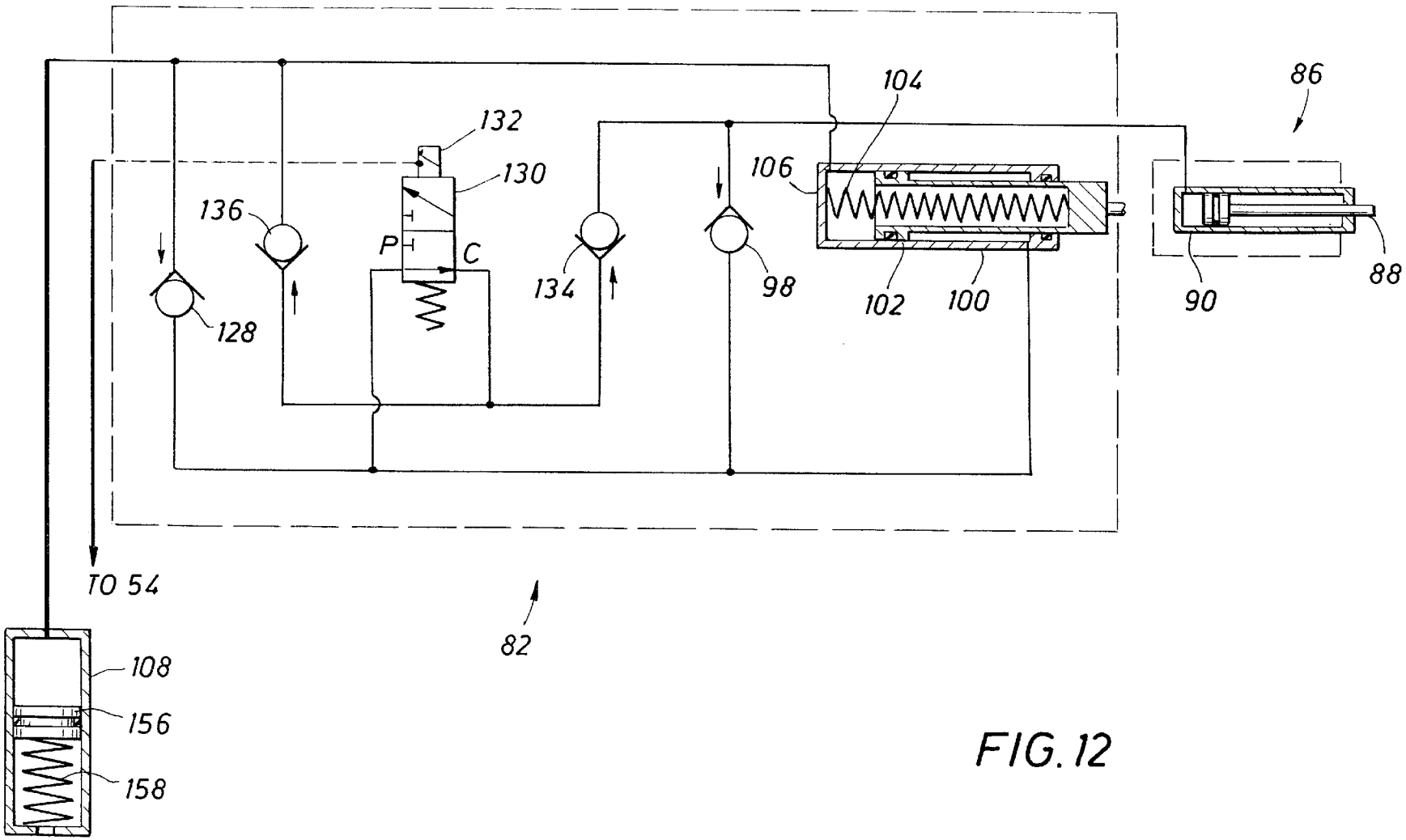
FIG. 12 is a functional schematic of the hydraulic elements of the conveyor sonde.

The function of hydraulics block 82 is best described with reference to FIG. 12. To repeat, hydraulic fluid initially displaced from cocking cavity 90 flows through check valve 98 to annular cavity 100 about retract piston 102, forcing piston 102 to the left. Simultaneously, fluid from cavity 106 flows out of the retract assembly to a compensating piston cavity 108 in the compensator section of the sonde. Because pressure in cavity 100 is greater than in cavity 106, backflow through check valve 128 is prevented. The hydraulic block contains a normally open solenoid valve 130, which is kept closed during normal operation of the sonde by maintaining an electrical voltage across the winding of a solenoid 132.

In the event of a power failure with the retract assembly in a position where the cocking piston can fully extend (i.e., away from the lower bulkhead wall of the sonde), retract spring 104 forces retract piston 102 to the right, retracting the cam anchors. Fluid displaced from cavity 100 flows through solenoid valve 130 and a check valve 134, to cocking cavity 90 as the cocking spring 96 (FIG. 9) forces cocking piston 88 outward.

If cocking piston 88 is prevented from extending fully, such as if the retract assembly is in its full forward position within the sonde, excess fluid from cavity 100 flows through solenoid valve 130 and a check valve 136 to compensator cavity 108. Thereafter, once the cocking piston is unobstructed, it will be automatically extended by internal hydraulic pressures to passively reset the cocking system.

Figure 13:
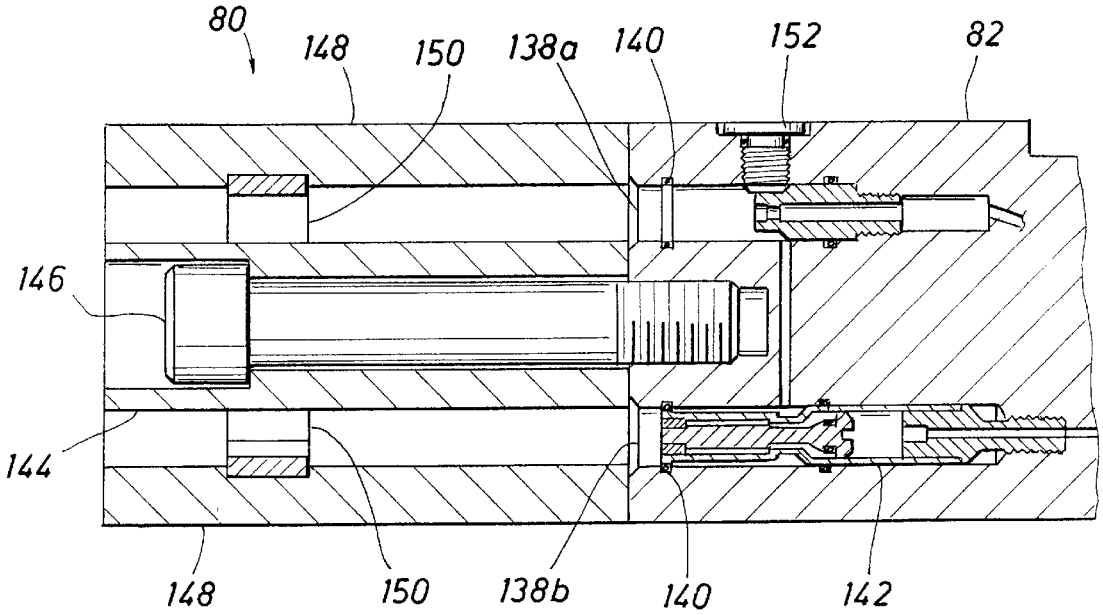
FIG. 13 is an enlarged view of the clamp section shown in FIG. 9.
Figure 14:
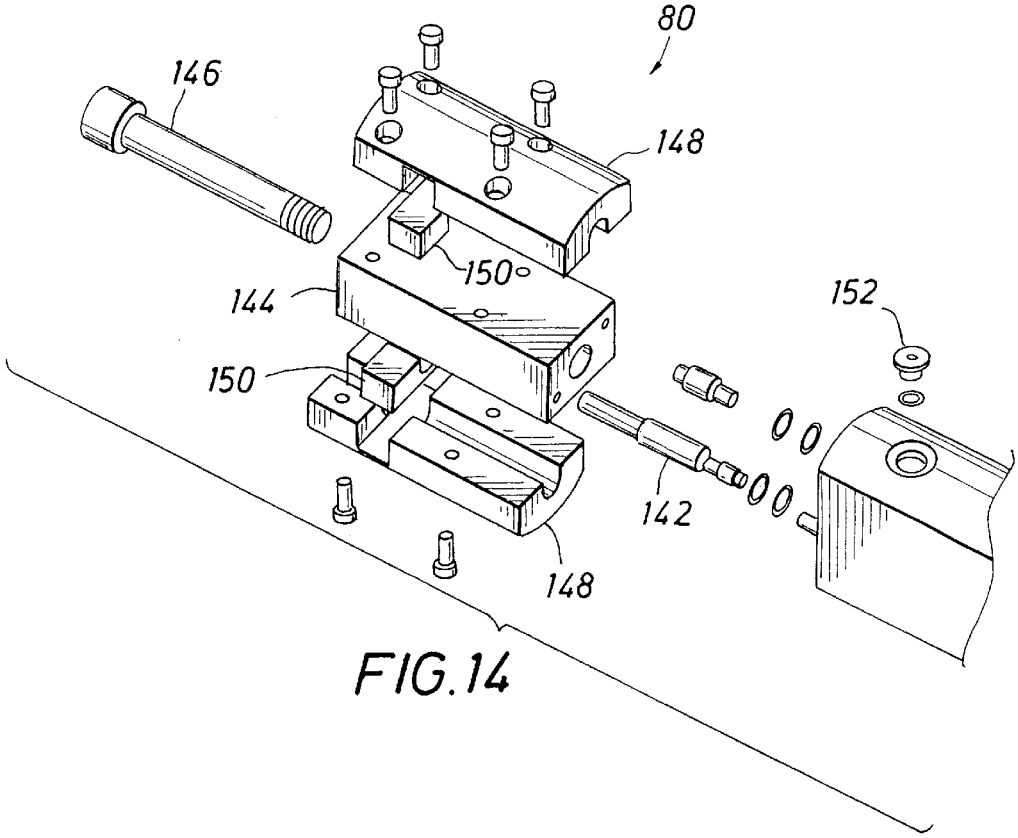
FIG. 14 is an exploded view of the clamp section of the retract assembly.

Referring next to FIGS. 13 and 14, retract assembly clamp 80 provides a secure attachment to the actuator rods of the sonde. The distal ends of the rods (not shown) are inserted into holes 138*a* and 138*b*, where they are sealed against by seals 140. A hydraulic quick-connect coupling 142 in hole 138*b* enables the rods to be disconnected from hydraulics block 82 without draining the hydraulic cavities of the retract assembly. A center block 144 of the clamp is secured to the face of the hydraulics block with a bolt 146, and side plates 148 are installed from opposite sides of the center block to hold the actuator rods in place with soft clamp pads 150. The structure of clamp 80 enables the retract assembly to be disconnected from the rest of the conveyor sonde without disassembling the rest of the sonde. A fill/bleed plug 152 is provided at the connection of the actuator rods to the retract assembly.

Figure 16A:
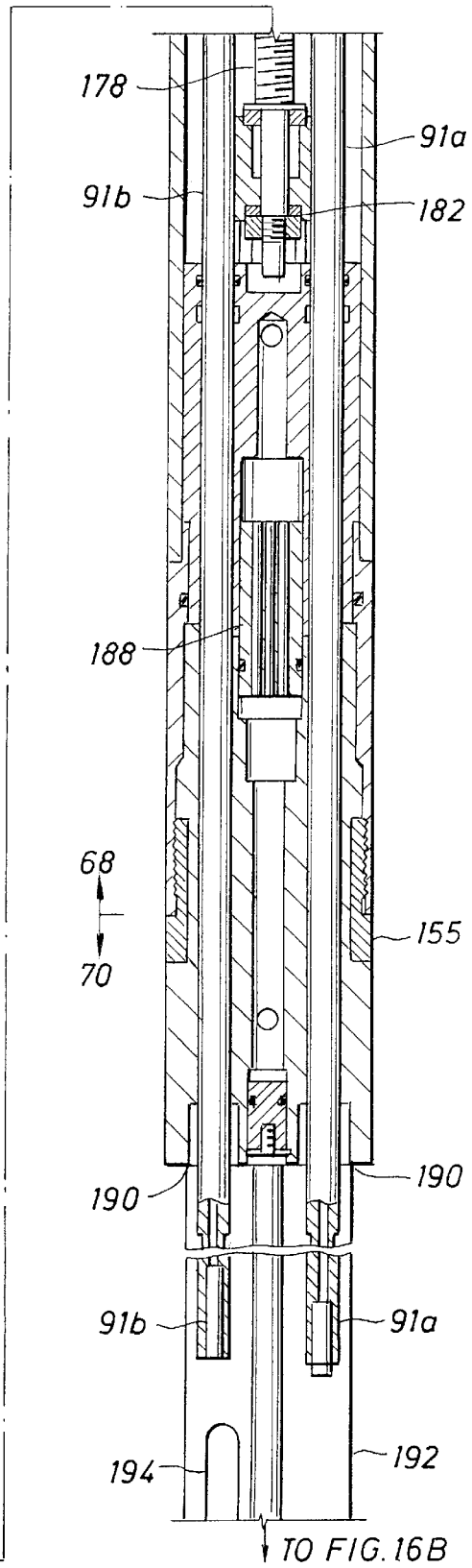

The rest of conveyor sonde 52 will be described with reference to FIGS. 15 and 16. Beginning with the upper end of the sonde (at the top of FIG. 15), upper head 64 provides for a dry electrical connection to rearward portions of the tool string and cable. In the upper end of compensator section 66, an upper oil/air bulkhead 154 provides an oil-tight seal about the electrical conductors, which extend along the length of the sonde. Adjacent sections of the sonde are coupled with split threaded rings 155, with electrical connections between adjacent sections made with bayonet-style connectors. Compensator section 66 also contains an annular compensator piston 156 which is attached to the end of compression spring 158 and has seals for sealing against the surfaces of compensator tube 160 and housing 162. Defined above piston 156 is an annular compensator cavity 108, which is in fluid communication with lower portions of the sonde and the retract assembly via ports 164 and the inner bore of shaft 160. The annular cavity 166 below piston 156 is exposed to the well bore through side port 168. A compliant stop 170 at the lower end of cavity 166 prevents piston 156 from striking the end of the cavity and ensures that the piston remains sealed against the inner surface of the housing bore.

The actuator section 68 of the sonde will now be described in greater detail. At the upper end of the actuator section, electrical connector assembly 172 enables the actuator and compensator sections to be readily disconnected, and also allows hydraulic fluid to flow between the sections. Connector 172 also provides electrical connection between the cable and all lower electrical systems, including conductors supplying power to motor assembly 174. Motor assembly 174 includes a brushless DC motor, operated by pulse-width modulating a DC voltage of about 800 volts, and a planetary gear train providing a 10:1 speed reduction. The assembly is approximately two inches in diameter, three inches long, and develops about one horsepower. Motor assembly is compliantly mounted to the housing of the actuator section, and its output shaft is spline-fit to a universal joint coupling 176, the other side of which is attached to ball screw shaft 178. Ball screw shaft 178 is mounted within the actuator section housing upon an upper bearing assembly 180 and a lower bearing assembly 182. A ball nut 184 rides upon the ball screw shaft, such that it is linearly displaced along the primary axis of the tool string by the rotation of motor assembly 174. Attached to the ball nut is an upper rod mount 186 which holds the upper ends of actuator rods 91*a* and 91*b*. The linear displacement of ball nut 184 displaces rods 91*a* and 91*b* along the tool axis, thereby moving the retract assembly. Both rods 91*a* and 91*b* are hollow, with the bore of rod 91*b* providing a hydraulic flow path between the retract assembly and the rest of the sonde. A single conductor (not shown) extends along the sealed bore of rod 91*a* to provide electrical communication with solenoid valve 130 (FIG. 9). This conductor is run through a coil of tubing (not shown) about the ball screw shaft between ball nut 184 and bearing assembly 180, to protect the conductor as the distance between ball nut and bearing changes. The lower end of the actuator section contains an electrical connector assembly 188 for electrical communication with rail section 70.

The upper end of rail section 70 contains sliding seals 190 for sealing against rods 91*a* and 91*b*. Tubing (not shown) between the upper and lower ends of the rail section carry electrical conductors and hydraulic fluid along side rails 192. An oval groove 194 cut into each side rail receives tongues 196 (FIG. 7) on each side of the cocking piston section of the retract assembly, to guide the retract assembly along the rails.

The lower head section 72 of sonde 52 contains another oil/air bulkhead 154 and provides for connection to lower portions of the tool string.

Referring to FIGS. 17A–17C, outer cam member portions 198*a* and 198*b* are two examples of different sizes of outer cam member portions provided for different well bore diameters. As seen in FIG. 17B, the outer cam member portions are relatively narrow, and have broad, flat sides. Embedded in the distal edge of some cam members is a row of pointed carbide inserts 200 for gripping steel casing walls.

Figure 18:
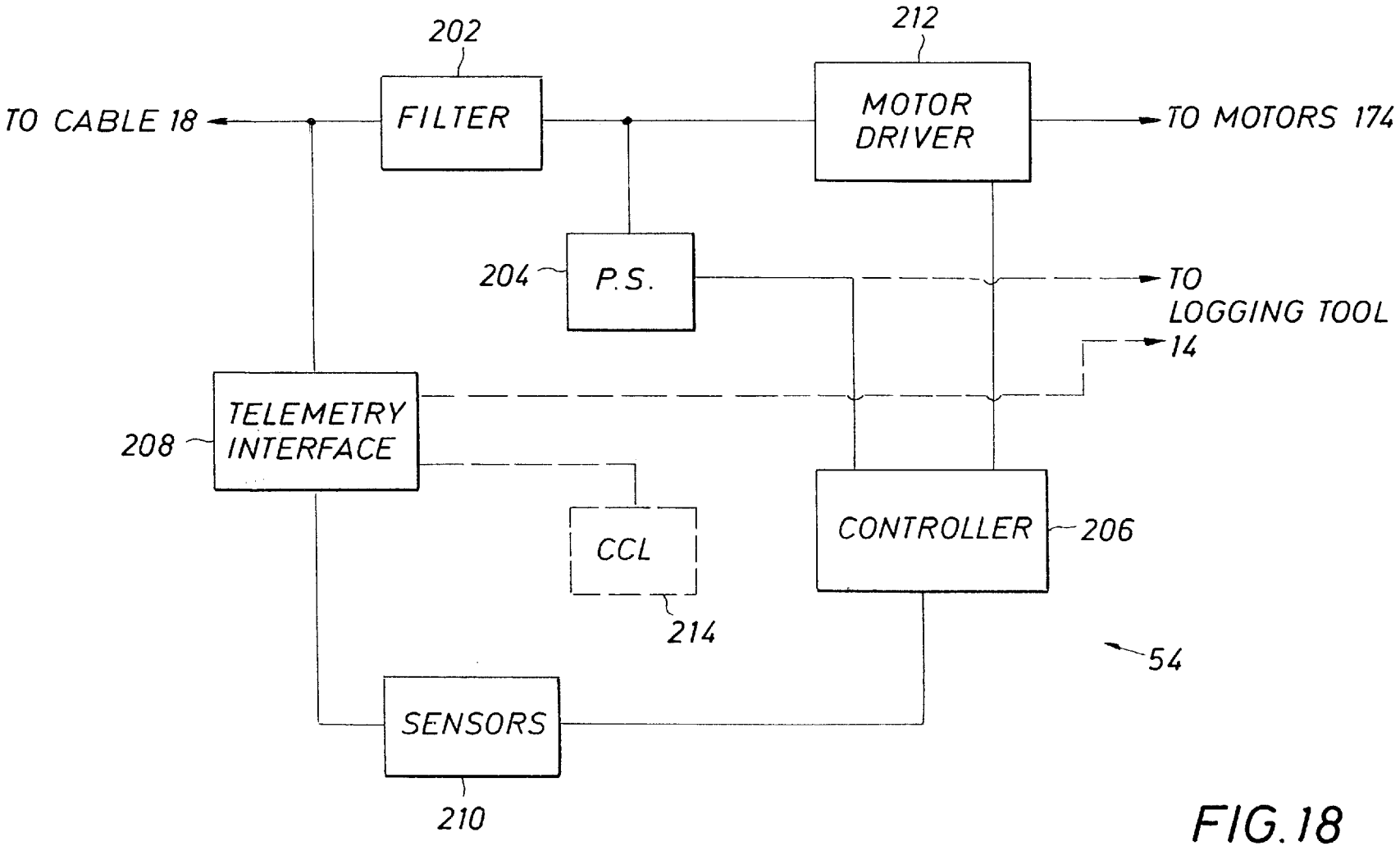
FIG. 18 is a functional schematic of the electronics cartridge of the tool string of FIG. 5, including an optional logging sensor.

Referring to FIG. 18, electronics cartridge 54 provides for downhole control of the two conveyor sondes 52 of FIG. 5. It should be noted that FIG. 18 illustrates diagrammatically the function of the electronics cartridge. It will be understood by those of skill in the art that physical embodiments will contain, in some instances, multiple components which together perform the function illustrated by any given element shown in FIG. 18. For example, one present embodiment of the cartridge contains no fewer than five microprocessors for controlling various aspects of the function of the tool string.

Control signals and data are superimposed upon the high DC voltage of the mono-cable 18 running to the tool from the well surface, by known telemetry techniques which yield a data transmission rate of between 13K and 26K symbols per second. Power from cable 18 is conditioned by filters 202 for powering the actuator motors, and stepped down to lower voltages in power supply 204 for powering the electronics. One or more on-board microprocessor controllers 206 control downhole functions, and telemetry electronics 208 are provided for generating and decoding data signals from cable 18, and for separating the high voltage power from the telemetry overlay with sufficient isolation to avoid corruption of the telemetry signals. The nominal cable voltage at the tool string is about 600 volts DC while tractoring, but flucuates as the controller varies motor parameters to maintain a reasonably constant tractoring speed with feedback provided from resolvers in motors 174.

On-board sensors 210 are included for monitoring system parameters for safety and other functions. For instance, thermocouples monitor power supply heat sink temperatures and a strain gage monitors cable tension, for automatically retracting the cam anchors and stopping the actuator motors if undesirable conditions are sensed. Alternatively, motor speed, voltage and current may be monitored to estimate motor torque. Motor driver 212 contains the pulse-width modulated power transistors for powering the three windings of each motor, and is preferably physically separated from the telemetry electronics by a sufficient distance to reduce signal noise.

In some cases, electronics cartridge 54 is adapted to interface with a separate downhole logging tool (such as logging tool 14 of FIG. 5). In some cases the logging sensor or sensors, such as CCL sensor 214, are incorporated into the electronics cartridge itself, such that a separate logging tool is not required. Of course, the electronics cartridge may be readily equipped to do both simultaneously.

Electronics cartridge 54 also provides outputs (not shown) of both filtered and unfiltered cable voltage for use by other downhole tools of the string.

A computer at the top of the well (not shown) provides a user interface. In some cases, the surface computer is also adapted to monitor cable tension and current, and to shut down the system if undesirable conditions are sensed. A zero current, for example, may indicate an open cable.

In use, the tool string should not be conveyed so far along the well bore that friction between the cable and well surface upon retraction develops a greater load than the strength of the cable can withstand.

While the above embodiments have been described with respect to conveying a logging tool (which may or may not be incorporated into the above-described electronics cartridge), it should be understood that the conveyance system of the invention is equally suited for conveying other types of downhole tools along a deviated well. For instance, perforating guns and other well completion tools may also be conveyed along such wells by the above described apparatus and method.

The foregoing description of the preferred and alternate embodiments of the present invention have been presented for purposes of illustration and description. It is not intended to be exhaustive or limit the invention to the precise form disclosed. Obviously, many modifications and variations will be apparent to those skilled in the art. The embodiments were chosen and described in order to best explain the principles of the invention and its practical application, thereby enabling others skilled in the art to understand the invention for various embodiments and with various modifications as are suited to the particular use contemplated. It is intended that the scope of the invention be defined by the accompanying claims and their equivalents.

What is claimed is:

1. An apparatus for conveying a tool along a non-vertical well, the apparatus comprising an elongated housing adapted to be attached to a tool to be conveyed;

a cam anchor arranged to extend laterally from the housing and pivotably attached to the housing at a linearly displaceable pivot point; and an actuator operatively connected to the housing and constructed to linearly displace the cam anchor pivot point along the housing;

the cam anchor having an arcuate cam surface for slidingly engaging an inner surface of the well as the cam anchor pivot point is displaced in a first direction, and for gripping the inner surface of the well as the cam anchor pivot point is displaced in a second direction, to convey the tool along the well.

2. The apparatus of claim 1, comprising first and second said cam anchors attached to the housing at respective pivot points spaced along the housing, the arcuate cam surfaces of the cam anchors aligned in a common direction; and first and second said actuators constructed to separately displace the pivot points of the first and second cam anchors, respectively, to convey the tool along the well.

3. The apparatus of claim 1, wherein the cam anchor is adapted to pivot about its pivot point to a retracted position with its arcuate cam surface disengaged from the inner surface of the well.

4. The apparatus of claim 3 further comprising a spring arranged to bias the cam anchor toward the retracted position.

5. The apparatus of claim 3, adapted to automatically retract the cam anchor to the retracted position upon a loss of power.

6. The apparatus of claim 5, wherein the housing defines a slot; the apparatus including a retract assembly comprising the cam anchor and a cocking piston, the retract assembly being linearly displaceable along the slot by the actuator between forward and rearward positions, the cocking piston extending from the retract assembly and arranged to engage a surface of the housing at one end of the slot and to be compressed by the housing as the retract assembly is displaced to the forward position, thereby urging the cam anchor toward an extended position.

7. The apparatus of claim 6, wherein the retract assembly includes a retract assembly housing;

a retract piston disposed within a bore of the retract assembly housing and connected to the pivot point of the cam anchor, the retract piston in hydraulic communication with the cocking piston and adapted to be displaced within the housing bore to move the pivot point as the cocking piston is compressed; and an extension spring connected to the retract assembly housing and the cam anchor and arranged to urge the cam anchor toward its extended position as the cocking piston is compressed.

8. The apparatus of claim 7, wherein the retract assembly includes a first one-way check valve arranged to enable hydraulic flow from the cocking piston to the retract piston as the cocking piston is compressed;

a normally open solenoid valve arranged to enable hydraulic flow from the retract piston to the cocking piston in the absence of electrical voltage at the solenoid; and a spring arranged to bias the retract piston toward a cam-retracting position.

9. The apparatus of claim 8, further defining a compensation cavity in hydraulic communication with the retract piston and adapted to receive hydraulic fluid from the retract assembly when the solenoid valve opens and the cocking piston is blocked from fully extending.

10. The apparatus of claim 1, wherein the cam anchor comprises a pair of oppositely directed anchor members pivotably attached to the housing at a common pivot point and arranged to simultaneously engage opposing portions of the inner surface of the well.

11. The apparatus of claim 10, wherein both the anchor members are adapted to pivot about their common pivot point to retracted positions with their arcuate cam surfaces disengaged from the inner surface of the well, the apparatus further comprising a spring arranged to bias both the anchor members toward the retracted positions.

12. The apparatus of claim 1, wherein the cam anchor has a plurality of projections extending from its arcuate cam surface for gripping the inner surface of the well.

13. The apparatus of claim 1, wherein the inner surface of the well comprises earth.

14. The apparatus of claim 1, wherein the inner surface of the well comprises well casing.

15. The apparatus of claim 1, wherein the conveyed tool contains a logging sensor responsive to a downhole well characteristic; and electronics adapted to activate the actuator.

16. A method for conveying a tool along a non-vertical well to a predetermined position, the method comprising:

(a) attaching the apparatus of claim 1 to a tool to be conveyed;

(b) lowering the tool and apparatus into a non-vertical well;

(c) activating the actuator to displace the cam anchor pivot point in the first direction to slide the cam anchor surface along an inner surface of the well;

(d) activating the actuator to displace the cam anchor pivot point in the second direction to grip the inner surface of the well and convey the tool along the well; and (e) repeating steps (c) and (d) until the tool is conveyed to a predetermined position.

17. The method of claim 16, wherein the apparatus has first and second said cam anchors attached to the housing at respective pivot points spaced along the housing, the arcuate cam surfaces of the cam anchors aligned in a common direction; and first and second said actuators constructed to separately displace the pivot points of the first and second cam anchors, respectively, to convey the tool along the well.

18. The method of claim 17, the steps (c) and (d) comprising:

i) activating both actuators to displace both cam anchor pivot points in the second direction to engage the cam anchors against the inner surface of the well; and ii) sequentially activating each actuator to sequentially displace the cam anchor pivot points in the first direction to convey the tool along the well.

19. The method of claim 18 wherein the step i) comprises activating one actuator to displace one cam anchor pivot point in the first direction, while simultaneously activating the other actuator to displace the other cam anchor pivot point in the second direction.

20. The method of claim 17, comprising between the steps (b) and (c), activating both actuators to displace both cam anchor pivot points in the second direction to engage the cam anchors against the inner surface of the well; and, while maintaining one cam anchor in engagement with the inner surface of the well, performing steps (c) and (d), the steps (c) and (d) comprising activating the actuator associated with the other cam anchor to reciprocate the other cam anchor pivot point in the first and second directions to convey the tool along the well.

21. The method of claim 20 wherein the one cam anchor is biased toward the inner surface of the well by a spring.

22. The method of claim 16, wherein the conveyed tool contains a logging sensor responsive to a downhole well characteristic.

23. The method of claim 22, wherein the conveyed tool also contains electronics adapted to activate the actuator.

* * * * *